US006786151B2

(12) United States Patent
Stiel

(10) Patent No.: US 6,786,151 B2
(45) Date of Patent: Sep. 7, 2004

(54) PRINTER OF AN OFFSET PRINTING MACHINE WITH SEPARABLE FRAME MODULES

(75) Inventor: Jürgen Alfred Stiel, Thüngen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/312,598

(22) PCT Filed: Mar. 30, 2001

(86) PCT No.: PCT/DE01/01214

§ 371 (c)(1),
(2), (4) Date: Jan. 22, 2003

(87) PCT Pub. No.: WO02/07972

PCT Pub. Date: Jan. 31, 2002

(65) Prior Publication Data

US 2004/0089177 A1 May 13, 2004

(30) Foreign Application Priority Data

Jul. 22, 2000 (DE) ..... 100 35 784

(51) Int. Cl.[7] ..... B41F 31/00

(52) U.S. Cl. ..... 101/335; 101/216; 101/217; 101/179; 101/220; 101/221

(58) Field of Search ..... 101/335, 216, 101/217, 231, 179, 220, 221

(56) References Cited

U.S. PATENT DOCUMENTS

| | | | | |
|---|---|---|---|---|
| 2,557,381 A | | 6/1951 | Huebner | |
| 3,892,178 A | | 7/1975 | Staamann | |
| 4,856,426 A | * | 8/1989 | Wirz | 101/217 |
| 5,042,378 A | * | 8/1991 | Germann | 101/152 |
| 5,136,942 A | * | 8/1992 | Germann | 101/177 |
| 5,142,978 A | * | 9/1992 | Borel | 101/177 |
| 5,640,906 A | | 6/1997 | Schmitt | |
| 5,718,172 A | * | 2/1998 | Ruckmann et al. | 101/177 |
| 5,794,531 A | * | 8/1998 | Keller | 101/479 |
| 5,809,882 A | * | 9/1998 | Ruckmann et al. | 101/177 |
| 6,041,707 A | * | 3/2000 | Petersen et al. | 101/232 |
| 6,050,188 A | | 4/2000 | Bolza-Schünemann | |
| 6,062,136 A | | 5/2000 | Bolza-Schünemann | |
| 6,539,857 B1 | * | 4/2003 | Weschenfelder | 101/137 |

FOREIGN PATENT DOCUMENTS

| | | |
|---|---|---|
| DE | 288088 | 1/1914 |
| DE | M21915X II | 3/1956 |
| DE | 2 234 089 | 9/1974 |
| DE | 33 12 903 A1 | 1/1984 |
| DE | 44 29 891 A1 | 2/1996 |
| DE | 198 03 809 A1 | 8/1999 |
| DE | 198 33 468 A1 | 1/2000 |
| EP | 0 352 521 | 1/1990 |
| EP | 0 563 007 | 9/1993 |
| EP | 0 638 419 | 2/1995 |
| EP | 0 958 917 A1 | 11/1999 |
| GB | 621144 | 4/1949 |
| WO | WO 97/02143 | 1/1997 |

* cited by examiner

*Primary Examiner*—Andrew H. Hirshfeld
*Assistant Examiner*—Dave A. Ghatt
(74) *Attorney, Agent, or Firm*—Jones, Tullar & Cooper PC

(57) ABSTRACT

A printer, that includes multiple printing groups, is mounted in the frame of an offset printing machine. Each printing group includes at least one printing cylinder, at least one transfer cylinder and at least one inking system. Two of these printing groups are arranged opposite to each other. At least one counter-pressure cylinder is arranged between these opposite printing groups. The frame has at least three separable frame modules. At least one printing group is located in a left module. At least one printing group is located in a right module. At least one counter-pressure cylinder is located in a module frame module situated between the left and right frame modules.

30 Claims, 2 Drawing Sheets

PRINTER OF AN OFFSET PRINTING MACHINE WITH SEPARABLE FRAME MODULES

FIELD OF THE INVENTION

The present invention is directed to a print unit of an offset printing press. Components of the print unit are supported in frame modules which are separable. Size ratios exist between various ones of the components.

BACKGROUND OF THE INVENTION

An offset printing press with two print units which are placed opposite each other is known from DE 198 33 468 A1. The print units each have two forme cylinders, two transfer cylinders and a counter-pressure cylinder. The print units which are placed opposite each other are seated in a frame consisting of two frame modules. By separating the frame modules, the print units can be arranged so their distance in relation to each other can be changed.

A webfed rotary printing press is known from EP 0 958 917 A1, whose printing group consists of two print units which are arranged opposite each other. The paper web to be imprinted can be conducted in a vertical center plane between the print units. Each of the individual print units has a forme cylinder, a transfer cylinder and an ink unit. The paper web is conducted between the transfer cylinders, which are arranged opposite each other, of two print units which are also arranged opposite each other in such a way that the opposing transfer cylinder operates in the manner of a counter-pressure cylinder. The individual printing groups, which are arranged on top of each other and each consisting of two print units, are seated in a frame in such a way that they can be displaced in the vertical direction so that their distance can be changed.

A multi-color web-fed rotary printing press is known from DE 44 29 891 A1, and whose print units each have a forme cylinder and a transfer cylinder. In this device, the transfer cylinder has twice the circumference of the forme cylinder. Two print units are arranged opposite each other in a frame which has three frame modules. The frame modules can be arranged so their distance from each other can be changed in such a way that the area between the individual forme cylinders and the oppositely located transfer cylinder is accessible to the operators.

EP 0 563 007 A1 and U.S. Pat. No. 2,557,381 both disclose how to arrange different cylinders in several separable frame modules.

DE-PS M 219 15XII./15d shows a printing group in which the forme and transfer cylinders have identical diameters, and the counter-pressure cylinder has twice the diameter of the forme and transfer cylinders.

A web-fed offset printing press is known from EP 0 352 521 A2, whose print units each have a forme cylinder, a transfer cylinder and utilize a common satellite cylinder, which operates in the manner of a counter-pressure cylinder. The circumference of the satellite cylinder corresponds to the circumference of the forme cylinder and to half the circumference of the transfer cylinder.

An offset printing group is known from DE 198 03 809 A1, whose print units have a forme cylinder, a transfer cylinder and a satellite cylinder, which is assigned to two transfer cylinders. The circumference of the transfer cylinder is twice the circumference of the forme cylinder, and the circumference of the satellite cylinder corresponds to the circumference of the transfer cylinder.

SUMMARY OF THE INVENTION

The object of the present invention is directed to providing a print unit for an offset printing press.

In accordance with the present invention, this object is attained by the provision of a plurality of print units which are arranged to form printing groups. These printing groups are each formed by oppositely arranged forme cylinders and transfer cylinders. The opposing print groups are supported in separable left and right frame modules. At least one counter-pressure cylinder is situated in a center module. The circumference of the counter-pressure cylinder is 1.5 times or twice the circumference of the transfer cylinder and a whole number multiple of the printed page height.

The advantages to be gained by the present invention consist, in particular, in that the frame for seating the cylinders of the offset printing press in a manner fixed on the frame is composed of three separable frame modules. The forme cylinders, transfer cylinders and ink units and, to the extent provided, other installations, such as, for example dampening units, of the left print units are seated in a left or first frame module. A right or second frame module correspondingly receives the forme cylinders, transfer cylinders and ink units of the right print units. A center or intermediate frame module is provided between the left and right, or first and second frame modules. The counter-pressure cylinders, which act together with the transfer cylinders when the web of material, for example a paper web, is imprinted, are seated in this center or intermediate frame module. By separating and moving the individual frame modules away from each other, the print units can be opened such that the oppositely located counter-pressure cylinders on the center frame module, as well as the forme and transfer cylinders on the right or left frame module, are simultaneously accessible.

The frame modules can be displaced in a direction extending radially in respect to the axes of rotation of the cylinders. Alternatively or coincidentally, the modules can be moved in an axis-parallel direction in respect to the axes of rotation of the cylinders.

A further advantage to be gained by the present invention consists, in particular, in that the circumference of the counter-pressure cylinder corresponds to 1.5 times or to twice the circumference of the transfer cylinder. Furthermore, the circumference of the counter-pressure cylinder must, at the same time, correspond to a whole number multiple of the height of a printed page, taken in the circumferential direction of the forme cylinder. As a result of this, extraordinarily rigid counter-pressure cylinders are created, which do not exceed permissible deformation tolerances even under the highest stress. Moreover, a good support effect in respect to the other cylinders of the print units is also achieved.

Selecting the circumference of the counter-pressure cylinder to correspond to 1.5 times or to twice the circumference of the transfer cylinder is particularly advantageous if, in the course of imprinting a web of material, a counter-pressure cylinder cooperates, in the manner of a satellite cylinder, with respectively two transfer cylinders, which are arranged on top of each other, of two print units. Thus, particularly compact structures result from using the circumference ratios when installing the cylinders in the frame of an offset printing press.

If the circumference of the forme cylinder substantially corresponds to the height of a printed page, and in particular to the height of a newspaper page, so that if one printed side can be imprinted during one revolution of the forme cylinder, it is particularly advantageous for the support of the forme cylinder to select a transfer cylinder with twice the circumference of the forme cylinder. Because of this, the forme cylinder is supported by the substantially more rigid transfer cylinder in an advantageous manner. In accordance with a preferred embodiment of the present invention, with this circumferential ratio between the forme cylinder and the transfer cylinder, the circumference of the counter-pressure cylinder can be designed to be 1.5 times the circumference of the transfer cylinder. With this constellation, the result is that the circumference of the counter-pressure cylinder substantially corresponds to three times, and thus to a whole number multiple, of the height of the printed page.

In accordance with a further preferred embodiment of the present invention, the circumference of the forme cylinder substantially corresponds to twice the height of a printed page, so that two printed pages can be printed during one revolution of the forme cylinder. In this embodiment, the circumference of the transfer cylinder is selected to correspond to the circumference of the forme cylinder, and the circumference of the counter-pressure cylinder again corresponds to 1.5 times the circumference of the transfer cylinder. With this constellation of cylinder circumferences, the result also is that the circumference of the counter-pressure cylinder substantially corresponds to three times, i.e. a whole number multiple, of the height of a printed page.

In accordance with yet a further preferred embodiment, the circumference of the forme cylinder substantially corresponds to the height of a printed page, and the circumference of the transfer cylinder is selected to correspond to the circumference of the forme cylinder. To achieve advantageous relationships between the cylinder circumferences in this embodiment, the circumference of the counter-pressure cylinder is selected to be twice the circumference of the transfer cylinder. The circumference of the counter-pressure cylinder now substantially corresponds to twice, and thus to a whole number multiple, of the height of a printed page.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 1:
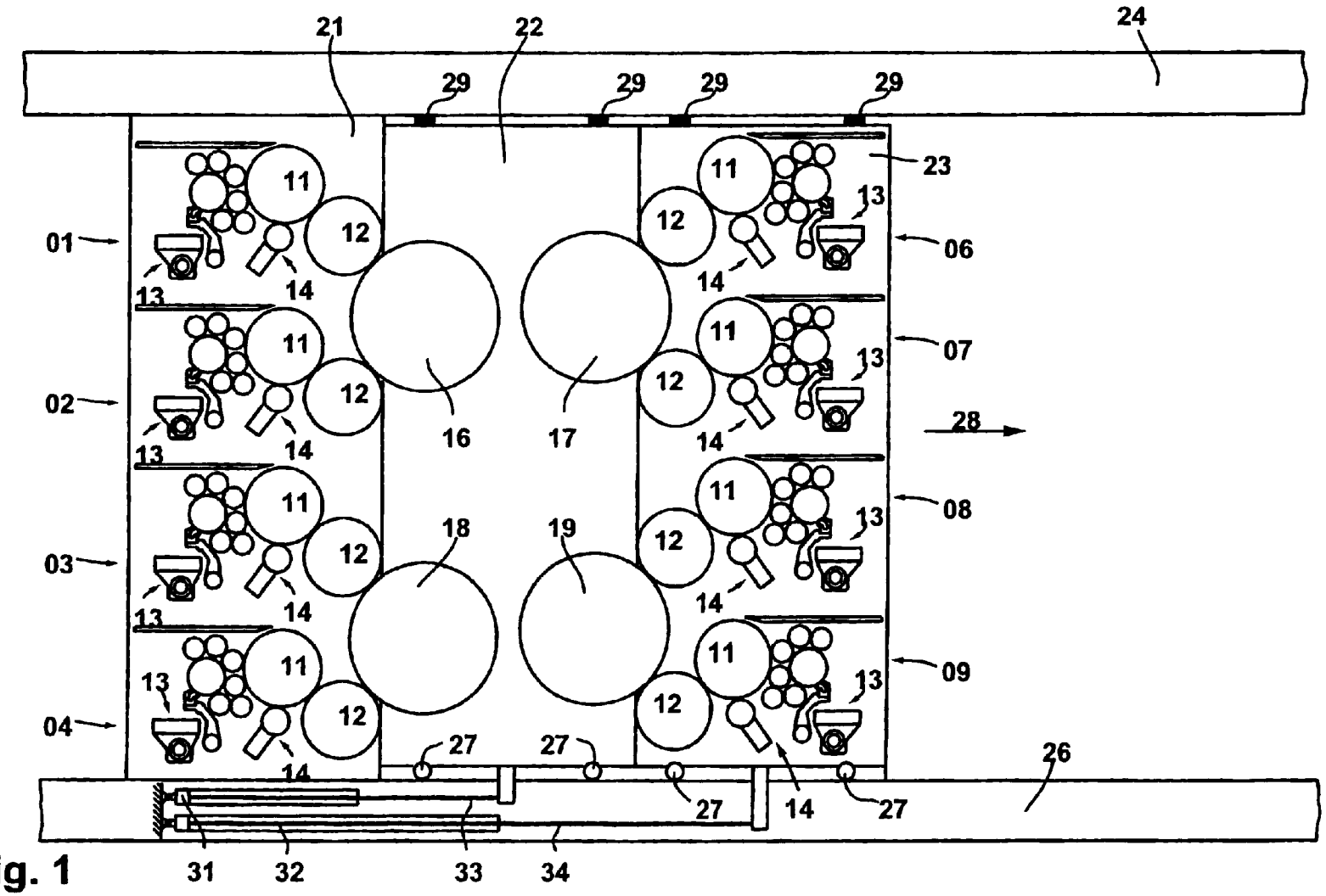
FIG. 1, a side elevation view of a preferred embodiment of an offset printing press in accordance with the present invention with eight printing groups arranged in a locked frame, and in FIG. 2, a side elevation view of the offset printing press depicted in FIG. 1 with the frame modules moved apart.

Referring initially to FIG. 1, an offset printing press, or a section of an offset printing press has, for example, a print unit consisting of, for example, eight printing groups 01 to 04, 06 to 09. Each one of the printing groups 01 to 04, 06 to 09 includes a forme cylinder 11, a transfer cylinder 12, an ink system 13, in particular an anilox short ink system 13, and a dampening unit 14. Each two of the printing groups 01, 06; 02, 07; 03, 08; and 04, 09 are arranged opposite each other in the frame of the offset printing press, as seen in FIG. 1. In the course of imprinting a web of material, such as, for example a paper web, one counter-pressure cylinder of a group of counter-pressure cylinders 16 to 19 cooperates with two transfer cylinders 12 of the two printing groups 01, 02; 03, 04; 06, 07; or 08, 09, which are arranged underneath each other. The frame for seating the cylinders of the printing groups 01 to 04, 06, to 09 is composed of three separable frame modules 21 to 23. Each one of the separable frame modules 21 to 23 consists of two lateral, spaced frame elements, in each of which frame elements an end of the cylinders of the printing groups 01 to 04, 06 to 09 is seated. The forme cylinders 11 and transfer cylinders 12 of the left or first printing groups 01 to 04 are seated in the left or first frame module 21, and the forme cylinders 11 and transfer cylinders 12 of the right or second printing groups 06 to 09 in the right or second frame module 23. The counter-pressure cylinders 16 to 19, which act in the manner of satellite cylinders, are seated in the center or intermediate frame module 22.

In the operating state of the offset printing press of the present invention, which is only schematically indicated in FIG. 1, the sides of the frame modules 21 to 23 are moved to their closed position and come to rest against each other. For the exact alignment of the relative position of the frame modules 21 to 23 in respect to each other in this closed position, it is possible, for example, to provide centering pins and centering bores, which are not specifically represented, in the contact faces which can be brought to rest against each other. After closing the frame by moving the frame modules 21 to 23 against each other, the frame modules 21 to 23 can be connected with each other by locking devices, which are also not specifically represented, and which may be, for example motor-driven locking spindles, so that the now closed frame modules 21 to 23 cannot be displaced in relation to each other during the operation of the offset printing press.

A press frame which may be constructed from transverse upper support frame 24, and lower transverse support frame 26, for example, can be provided for seating and receiving the frame modules 21 to 23 in the offset printing press, for example, and between which frames 24 and 26 the frame modules 21 to 23 are seated in a load-transferring manner. In the preferred embodiment represented in FIG. 1, the left or first frame module 21, which is connected, fixed to the frame and which is therefore fixed in place, together with the transverse supports 24, 26, is used as the reference point for the frame of the offset printing press. Each of the other two frame modules 22, 23 is supported by rollers 27 on rails, that are not specifically represented in FIG. 1, which are provided at the transverse lower support frame 26, so that they can be arranged in a manner where their distance in relation to the left frame module 21 can be changed. Guide pins 29, which come into engagement with guide grooves arranged on the transverse upper support frame 24, are provided for guiding the frame modules 22, 23 when they are being displaced in a direction radially in respect to the axis of rotation of the cylinder 11, 12, and as indicated by the direction of movement arrow 28.

Two drive mechanisms 31, 32, which are embodied in the manner of hydraulic cylinders 31, 32, are provided on the transverse lower support frame 26. By extending, or retracting the piston rods 33, 34 of the drive mechanisms 31, 32, respectively, the displaceably seated frame modules 22, 23 can be displaced in the direction of the movement arrow 28, i.e. in a radial direction in respect to the axis of rotation of the cylinder 11, 12, or in the opposite direction.

Figure 2:
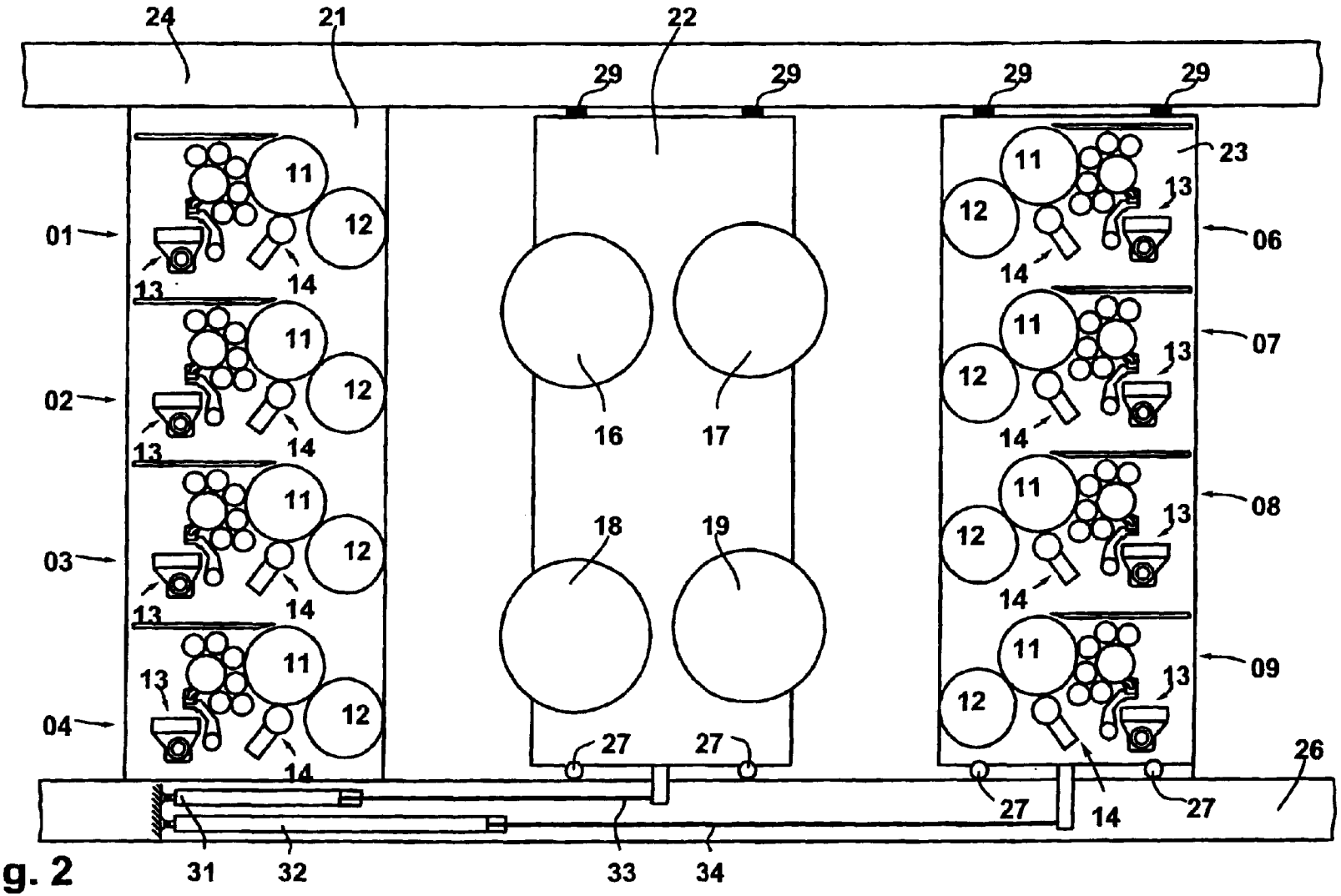

FIG. 2 depicts the frame modules 21 to 23 in the unlocked and moved-apart state. By moving the frame modules 21 to 23 apart, the printing groups 01 to 04, 06 to 09 can be made accessible. The forme cylinders 11 and the transfer cylinders 12 in each of the printing groups, as well as the counter-pressure cylinders 16 to 19 can be accessed, in a simple way, by the press operators. It is also within the scope of the present invention, alternatively or in addition to the lockable arrangement of the frame modules 22, 23 represented in FIGS. 1 and 2, to seat at least two of the frame modules 21 to 23 so that they are displaceable in an axis-parallel direction in respect to the axes of rotation of the cylinders 11, 12. For the printing groups 01 to 04, and 06 to 09 represented in FIGS. 1 and 2, this would mean that the frame modules 22, 23 would be seated so that they could be displaced out of the drawing plane, or into the drawing plane.

The circumference of each of the forme cylinders 11 has been selected to be such that it substantially corresponds to twice the height of a printed page. This means that the inked images of two printed pages are transferred to the associated one of the transfer cylinders 12 during one revolution of each of the forme cylinders 11. To this end, it is possible, for example, to fasten each of two printing plates on one-half the circumference of the forme cylinders 11, or alternatively, to utilize a printing plate on which two printed pages are provided. The circumference of the transfer cylinders 12 corresponds to the circumference of the forme cylinders 11, so that the transfer cylinders 12 perform a rotating movement synchronously in respect to the movement of the forme cylinders 11. The circumference of the counter-pressure cylinders 16 to 19 corresponds to 1.5 times the circumference of the forme cylinders 11, or of the circumference of the transfer cylinders 12. The result of this is that, in the course of each full revolution of the counter-pressure cylinders 16 to 19, three printed pages are transferred by the transfer cylinder 12 to the paper web to be imprinted. Particularly advantageous installation conditions result from the selection of the circumferential ratio of 1.5 between the circumference of the transfer cylinder 12 and the circumference of the counter-pressure cylinder 16 to 19, in particular in connection with offset printing presses with transfer cylinders 12 which are arranged on top of each other and which cooperate with a counter-pressure cylinder 16 to 19 acting in the manner of a satellite cylinder.

While preferred embodiments of a printer of an offset printing machine with separable frame modules in accordance with the present invention have been set forth fully and completely hereinabove, it will be apparent to one of skill in the art that changes in, for example the web feeding mechanism, the overall size of the print unit and the like could be made without departing from the true spirit and scope of the present invention which is to be limited only by the appended claims.

What is claimed is:

1. A print unit of an offset printing press comprising:

a plurality of printing groups, each one of said plurality of printing groups including at least one forme cylinder, at least one transfer cylinder and at least one ink unit, each said forme cylinders having a forme cylinder circumference corresponding to a height of a printed page, each said transfer cylinder having a transfer cylinder circumference, said transfer cylinder circumference being equal to said forme cylinder circumference;

a first frame module with at least a forme cylinder, a transfer cylinder and an ink unit of one of said plurality of printing groups supported in said first frame module;

a second frame module with at least a forme cylinder, a transfer cylinder and an ink unit of another of said plurality of printing groups supported in said second module and opposing said at least one of said plurality of printing groups;

at least one counter pressure-cylinder arranged between said one and said another of said plurality of printing groups, said at least one counter-pressure cylinder having a counter-pressure cylinder circumference which is twice said transfer cylinder circumference; and an intermediate frame module located between said first and second frame modules, said at least one counter-pressure cylinder supported in said intermediate frame module, said first, second and intermediate frame modules being separable.

2. The print unit of claim 1 wherein said at least one counter-pressure cylinder is a satellite cylinder which can cooperate with at least two of said transfer cylinders to print a web of material.

3. The print unit of claim 2 wherein said counter-pressure cylinder can cooperate with two transfer cylinders arranged one below the other.

4. The print unit of claim 1 further including an ink unit in each of said first and second frame modules.

5. The print unit of claim 1 wherein a distance between each of said frame modules can be changed.

6. The print unit of claim 5 wherein said distance between each of said frame modules can be changed in a direction radially in respect to axes of rotation of said cylinders.

7. The print unit of claim 1 wherein one of said frame modules is fixed in place and the other ones of said frame modules are displaceable.

8. The print unit of claim 7 wherein said intermediate frame module is fixed in place.

9. The print unit of claim 7 wherein said first frame is fixed in place.

10. The print unit of claim 7 wherein said second frame is fixed in place.

11. The print unit of claim 1 further including means to lock said frame modules in place in an operational state of the print unit.

12. The print unit of claim 1 further including a frame, said frame modules being supported in said frame by rollers.

13. The print unit of claim 1 further including a drive mechanism for displacing said separable frame modules.

14. The print unit of claim 1 further including additional ones of said plurality of printing groups supported in said first and second frame modules opposite each other and spaced from said one and another of said plurality of printing groups.

15. The print unit of claim 1 wherein said ink unit of each said printing group is a conventional ink unit.

16. The print unit of claim 1 wherein said ink unit of each said printing group is an anilox short ink unit.

17. The print unit of claim 1 further including a dampening unit assigned to at least one of said plurality of printing groups.

18. The print unit of claim 1 wherein said forme cylinder in at least one of said plurality of printing groups is supported for movement relative to its associated ink unit.

19. The print unit of claim 1 wherein at least one of said plurality of printing groups has a structural height between twice and four times a forme cylinder diameter.

20. The print unit of claim 1 further including an individual drive mechanism for each cylinder in at least one of said plurality of printing groups.

21. A print unit of an offset printing press comprising:

a plurality of printing groups, each one of said plurality of printing groups including at least one forme cylinder, one transfer cylinder and at least one inking unit;

at least first and second counter-pressure cylinders arranged adjacent each other, each said counter-pressure cylinder having a counter-pressure cylinder circumference, each said transfer cylinder having a transfer cylinder circumference, each said forme cylinder having a forme cylinder circumference corresponding to a height of a printed page, said transfer cylinder circumference being equal to said forme cylinder circumference, said counter-pressure cylinder circumference being twice said transfer cylinder circumference, said counter-pressure cylinder circumference further being a whole number multiple of a height of a printed page in a circumferential direction of said forme cylinder, each said counter-pressure cylinder being a satellite cylinder and adapted to cooperate with two of said transfer cylinders.

22. The print unit of claim 21 wherein said counter-pressure cylinder can cooperate with two transfer cylinders arranged one below the other.

23. The print unit of claim 21 wherein said ink unit of each said printing group is a conventional ink unit.

24. The print unit of claim 21 wherein said ink unit of each said printing group is an anilox short ink unit.

25. The print unit of claim 21 further including a dampening unit assigned to at least one of said plurality of printing groups.

26. The print unit of claim 21 wherein said forme cylinder in at least one of said plurality of printing groups is supported for movement relative to its associated ink unit.

27. The print unit of claim 21 wherein at least one of said plurality of printing groups has a structural height between twice and four times a forme cylinder diameter.

28. The print unit of claim 21 further including an individual drive mechanism for each cylinder in at least one of said plurality of printing groups.

29. A print unit of an offset printing press comprising:

a plurality of printing groups, each one of said plurality of printing groups including at least one forme cylinder, one transfer cylinder and at least one inking unit;

at least first and second counter-pressure cylinders arranged adjacent each other, each said counter-pressure cylinder having a counter-pressure cylinder circumference, each said transfer cylinder having a transfer cylinder circumference, each said forme cylinder having a forme cylinder circumference said circumference of each said forme cylinder corresponding to twice a height of a printed page, wherein said circumference of each said transfer cylinder is equal to said forme cylinder circumference and said counter-pressure cylinder circumference is 1.5 times said transfer cylinder circumference.

30. A print unit of an offset printing press comprising:

a plurality of printing groups, each one of said plurality of printing groups including at least one forme cylinder, at least one transfer cylinder and at least one ink unit, each said forme cylinder having a forme cylinder circumference which corresponds to twice a height of a printed page, each said transfer cylinder having a transfer cylinder circumference equal to said forme cylinder circumference;

a first frame module with at least a forme cylinder and a transfer cylinder of one of said plurality of printing groups supported in said first frame module;

a second frame module with at least a forme cylinder and a transfer cylinder of another of said plurality of printing groups supported in said second module and opposing said at least one of said plurality of printing groups;

at least one counter-pressure cylinder arranged between said one and said another of said plurality of printing groups and having a counter-pressure cylinder circumference equal to 1.5 times said transfer cylinder circumference; and an intermediate frame module located between said first and second frame modules, said at least one counter pressure cylinder supported in said intermediate frame module, said first, second and intermediate frame modules being separable.

* * * * *